United States Patent [19]

Blaugher et al.

[11] 4,265,683

[45] May 5, 1981

[54] DEVELOPMENT OF GRAIN-ORIENTED IRON SHEET FOR ELECTRICAL APPARATUS

[75] Inventors: Richard D. Blaugher, Churchill Boro; Richard H. Hopkins, Monroeville, both of Pa.

[73] Assignee: Westinghouse Electric Corp., Pittsburgh, Pa.

[21] Appl. No.: 10,112

[22] Filed: Feb. 7, 1979

[51] Int. Cl.[3] ..... H01F 1/00

[52] U.S. Cl. ..... 148/120; 148/122

[58] Field of Search ..... 148/120, 121, 122

[56] References Cited

U.S. PATENT DOCUMENTS

| | | | |
|---|---|---|---|
| 3,351,501 | 11/1967 | Aspden | 148/112 |
| 3,573,112 | 3/1971 | Aspden | 148/31.55 |
| 3,636,579 | 1/1972 | Sakakura et al. | 148/111 |
| 3,849,212 | 11/1974 | Thornburg | 148/120 |
| 3,881,967 | 5/1975 | Cochardt | 148/120 |
| 3,892,605 | 7/1975 | Thornburg | 148/120 |

*Primary Examiner*—L. Dewayne Rutledge
*Assistant Examiner*—John P. Sheehan
*Attorney, Agent, or Firm*—R. A. Stoltz

[57] ABSTRACT

This is a method of producing grain-oriented, iron sheet for electrical applications. The process utilizes relatively pure iron which is deoxidized to have less than 50 ppm of oxygen. The carbon content is adjusted to 0.01–0.02 wt. % (preferably 0.010–0.015 wt. %). The material is hot rolled at a temperature of at least 800° C., cold rolled with a 60–75% reduction, recrystallized in an non-oxidizing atmosphere at 700°–820° C., cold rolled a second time with a 60–75% reduction, annealed at 700°–825° C. in a non-oxidizing atmosphere and cold rolled a third time with a 60–75% reduction and final annealed at 850°–900° C. for 50–200 hours in a reducing atmosphere.

9 Claims, 3 Drawing Figures

DEVELOPMENT OF GRAIN-ORIENTED IRON SHEET FOR ELECTRICAL APPARATUS

BACKGROUND OF THE INVENTION

This invention relates to processes for producing grain-oriented iron for electrical applications, and, in particular to primary recrystallization of relative pure iron.

The design considerations for AC electrical equipment, such as transformers and motors require core materials possessing high permeability, high electrical resistivity, high magnetic saturation, and low core losses. The material must also be sufficiently ductile to permit easy fabrication into thin sheet or strip, and in addition, for transformers must contain a high degree of preferred grain orientation (texture) having an easy direction of magnetization aligned parallel to a specific direction of the sheet. The grain-oriented iron-silicon alloy sheet presently provides a compromise in the above requirements for use in transformers. The addition of silicon to iron has been advantageous for a number of reasons, one of the most important being the suppression of the alpha-gamma transformation which has been obtained with silicon additions of greater than 2.2% silicon (all percent figures herein are weight percentage). For those alloys whose compositions lie outside the gamma loop on the equilibrium diagram, it is possible to perform high temperature annealing which removes impurities and greatly facilitates texture development by secondary grain growth. Silicon additions have also been advantageous for increasing the electrical resistivity, thus lowering eddy current losses, the latter being a component of the total core losses. The presence of silicon, however, lowers the saturation induction from 21,500 Gauss for pure iron to 20,400 for a grain-oriented iron-3.2% silicon alloy. The addition of silicon thus sacrifices saturation induction to obtain the above-mentioned advantages.

While there have been a number of proposals for materials using less than 2.2% silicon, these have generally been processes which (like the higher silicon processes) use secondary recrystallization. Such secondary recrystallization processes generally use a material such as aluminum nitride, manganese sulfide or boron to inhibit primary recrystallization. U.S. Pat. No. 3,573,112 issued to Aspden on Mar. 30, 1971 is a secondary recrystallization process and uses a small (0.00003–0.0005%) but significant amount of sulfur. U.S. Pat. No. 3,636,579, issued to Sakakura et al. on Jan. 25, 1972 uses 0.010–0.065% aluminum in a process which again utilizes secondary recrystallization. U.S. Pat. No. 3,351,501 issued to Aspden on Nov. 7, 1967 illustrates another secondary recrystallization process using sulfur.

A primary recrystallization process is described in U.S. Pat. No. 3,892,605, issued to Thornburg on July 1, 1975. That patent describes a method using an alloyed material containing 0.3–4.0% of one or more alloying agents (e.g., silicon, chromium, or cobalt).

SUMMARY OF THE INVENTION

This is a method for preparing magnetic iron for electrical equipment using grain-oriented pure iron having an intrinsically higher saturation induction that a silicon iron. Preferably, a thin gauge material is used to compensate for the reduced resistivity resulting from the removal of silicon.

This is a process of preparing a texturized, iron-based, primarily recrystallizabled material which may be described using miller indices as (110) [001]. The process utilizes deoxidized material containing at least about 99.9% iron (and which is substantially free of sulfur and aluminum) and an oxygen content of less than 50 ppm. The carbon content of the material is adjusted to 0.01–0.02%. Next, the process entails hot rolling the material (maintaining a temperature of at least 800° C. throughout the hot rolling), cold rolling the material to provide a 65–75% reduction, recrystallizing the material at 700–825° C. for 20–60 minutes in a non-oxidizing atmosphere without any substantial decarbonization, a second cold rolling the material to provide a 60–75% reduction, annealing at 700–825° C. for 5–50 minutes in a non-oxidizing atmosphere, and a third cold rolling of the material to provide another 60–75% reduction (preferably to a final thickness is 0.004–0.008 inches), and annealing the material for 50–200 hours at 850–900° C. in a reducing atmosphere.

BRIEF DESCRIPTION OF THE DRAWINGS

The invention can be best understood by reference to the following drawings in which.

DESCRIPTION OF THE PREFERRED EMBODIMENTS

Figure 1:
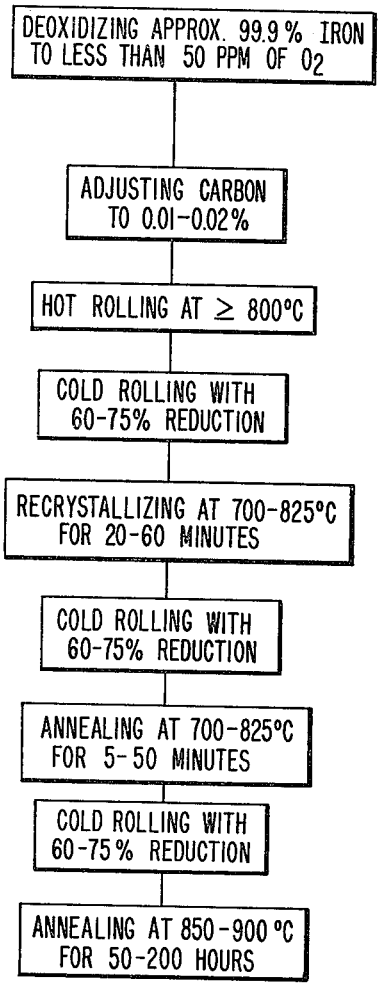
FIG. 1 is a flow diagram of the process.
Figure 2:
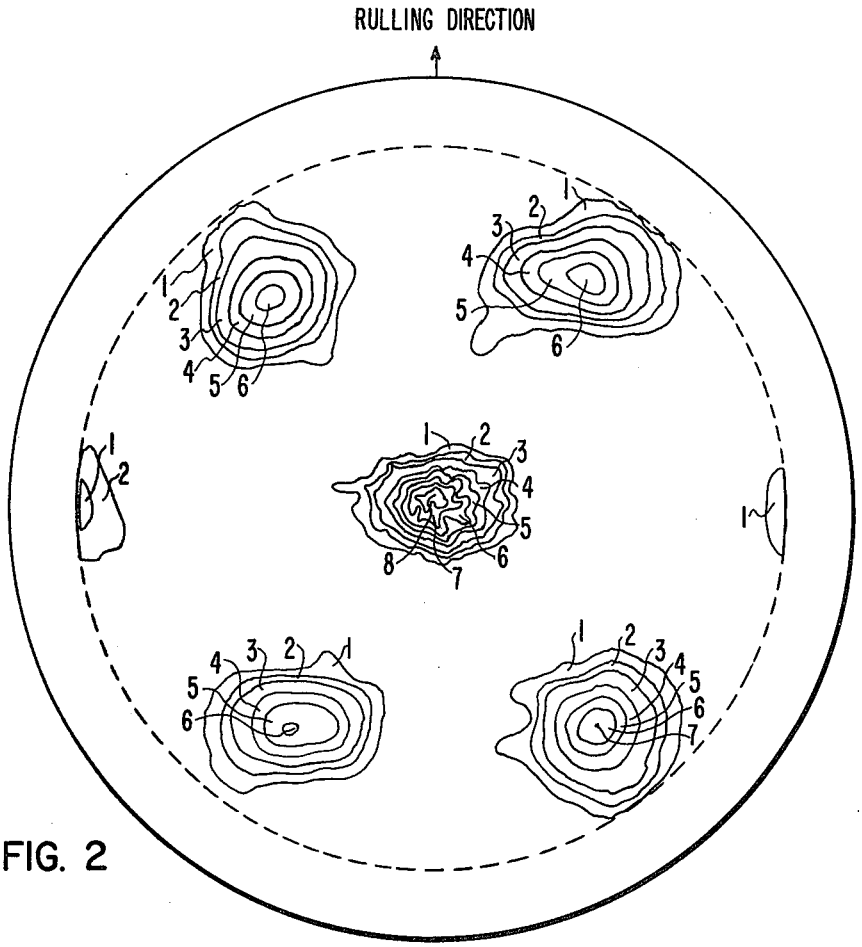
FIG. 2 is a (110) pole figure and FIG. 2A is a histogram, both from an iron material with 0.01 carbon, and with the contours of FIG. 2 being multiples of iron random standard intensity.
Figure 2A:
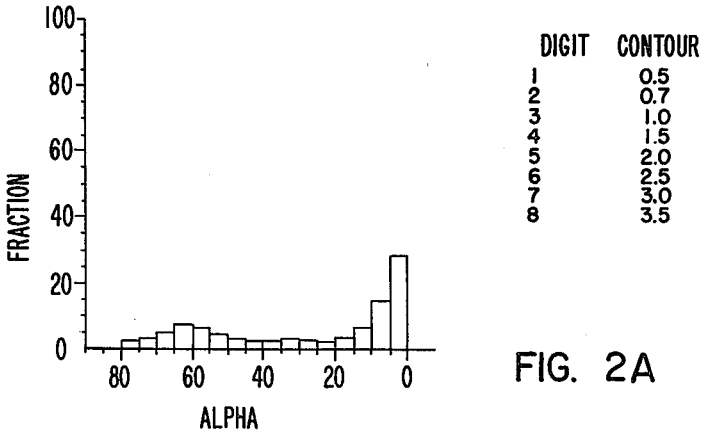

These materials are prepared using a primary recrystallization technique. Additions of materials such as aluminum, or sulfur, are not used. Ingots can be made from 99.9% pure electrolytic iron (referred to in the trade as A-104) by melting in a vacuum induction furnace at pressures of 0.01–0.015 microns, for example, and adding carbon to the melt as a deoxidizer. Adding carbon causes the formation of $CO_2$ and CO which then boils off from the melt. Periodic testing of the oxygen content is advisable, but the oxygen content is generally below 50 ppm when no further boiling off of $CO_2$ and CO can be observed. Carbon additions should be added relatively slowly to avoid too high a carbon content and the final carbon content is critical and must be adjusted to 0.01–0.02% (preferably 0.010–0.015%).

The material is then to be hot rolled, maintaining a finishing temperature (and a temperature throughout) of at least 800° C. Preferably, the material is heated in an inert atmosphere (e.g., argon) to at least 900° C. prior to being hot rolled, but, for convenience, rolling may be hot rolled in air. After one or two passes, if further rolling is still necessary, the slab should be recharged into the retort and reheated to about the starting temperature. This rolling and reheat procedure can be followed for as long as required to obtain the desired thickness of generally 0.025–0.128 inches (0.0635–0.325 centimeters) and preferably 0.060–0.080 inches (0.152–0.203 centimeters). Some decarburization occurs during hot rolling. A typical sample, for example, was found to contain 0.01 carbon and 0.0042% oxygen after hot rolling.

Prior to cold reduction, the material may be pickled and sand-blasted to remove scale. The material is cold rolled to provide a 60–75% reduction, generally to a 0.01–0.032 inch (0.0254–0.0813 centimeters) and preferably about 0.02 inch (0.0508 centimeters).

The material is then recrystallized at 700–825° C. for 20–60 minutes in a non-oxidizing (e.g., dry hydrogen) atmosphere. The material is cold rolled a second time with a 60–75% reduction, for example, 0.02 inch (0.0508 centimeter) thickness.

The material is then annealed at 700–825° C. for 5–50 minutes in a non-oxidizing (e.g., dry hydrogen) atmosphere. Preferably, the material is air quenched after the anneal. The material is preferably preheated to 850–900° C. for 10–50 minutes in dry hydrogen preceding the 5–50 minute anneal. It should be noted that the material may also be air quenched after the 20–60 minute recrystallization as such air quenching processes tend to give better crystal size control.

The material is then given a third cold rolling to its final thickness, again with a 60–75% reduction and preferably to a final thickness of 0.004–0.008 inches (about 0.0102–0.0203 centimeters). Again, this thickness is slightly thinner than normal to compensate for the somewhat lower resistivity as compared to silicon iron. It should also be noted that this process with three cold rolling steps gives significantly better results than a two-cold-rolling-step process.

The material is then annealed for 50–200 hours at 850–900° C. in a reducing atmosphere. This produces a primary recrystallized material having a very high magnetic saturation with a high development of the (110) [001]primary texture in the plane of the sheet.

It should be noted that the carbon and oxygen levels are both critical to the process. Without such controls, the desired magnetic saturation of above 17.6–18 kilogauss (kG) cannot be obtained. Preferably, the carbon content is adjusted to between 0.010 and 0.015% prior to hot rolling as this level has given the best results in terms of magnetic saturation.

Again, it is important that the material be substantially free of both sulfur and aluminum. While some processes have recommended additions of sulfur in low amounts, even these quite low amounts are difficult to remove in later processing and even extremely low amounts of sulfur have detrimental effects on the final product. It should also be noted that in primary recrystallization techniques are especially sensitive as the final anneal temperatures are generally substantially lower and that less sulfur (and less carbon) are removed during this final anneal than in secondary recrystallization processes. Even the higher temperature anneal of the secondary recrystallization processes, however, can still leave a detrimental amount of sulfur.

As an example of this process, a heat was prepared using 99.9 pure electrolytic iron, vacuum melted in an induction furnace at about 0.01 micron. Carbon was added slowly until all boiling off of $CO_2$ and CO ceased. The carbon content was measured and a small addition of carbon was made to give a carbon content of about 0.014% by weight. The slab was hot rolled from a sufficiently high starting temperature to maintain a finishing temperature of 800° C. (the starting temperature was obtained by heating in a furnace retort through which argon flowed continuously). A 1100° C. starting temperature was found to maintain the finishing temperature above 800° C. for two passes, after which the slab was recharged into the retort and reheated to the starting temperature. (The criticality of hot rolling temperature can be seen from a related experiment where the slab was hot rolled with a finishing temperature of only 700–750° C., as this lower temperature rolled slab did not give a final material having the desired (110) [001]texture). After hot rolling at a finishing temperature above 800° C. the material was cold rolled with an approximately 70% reduction to a thickness of about 0.050 inches and annealed (recrystallized) in dry hydrogen at 800° C. for 30 minutes. This recrystallized sheet was then cold rolled a second time to a thickness of about 0.02 inches (0.0508 centimeters). The material was then annealed at about 800° C. for 20 minutes in dry hydrogen. The material was then cold rolled a third time with another approximately 70% reduction to give a final thickness of about 0.006 inches (0.0152 centimeters). The material was then annealed for approximately 100 hours at 875° C. in a dry hydrogen atmosphere. This material was then analyzed, and showed a magnetic saturation of approximately 18,000 kilogauss and a primary recrystallized crystal structure.

The material prepared as described above was tested for 60 hertz AC properties. The AC data demonstrated losses comparable with conventional silicon-iron (i.e., this material has losses of 0.75 watts/lb at 15 kG, 1.02 watts/lb at 17 kG and 1.176 watts/lb at 18 kG).

The invention is not to be construed as limited to the particular forms described herein, since these are to be regarded as illustrative rather than restrictive. The invention is intended to cover all processes which do not depart from the spirit and scope of the invention.

We claim:

1. A process for preparing a textured, primary recrystallized, iron-based material suitable for magnetic applications, said process comprising:

(a) deoxidizing material consisting of at least about 99.9 wt.% iron to an oxygen content of less than 50 ppm, said material being substantially free of sulfur and aluminum;

(b) adjusting the carbon content of said material to 0.01–0.02 wt.%;

(c) hot rolling said material, maintaining a temperature of at least 800° C., throughout said hot rolling;

(d) cold rolling said material to provide a 60–75% reduction;

(e) recrystallizing said material at 700–825° C. for 20–60 minutes in a non-oxidizing atmosphere;

(f) cold rolling said material to provide a 60–75% reduction;

(g) annealing said material at 700–825° C. for 5–50 minutes in a non-oxidizing atmosphere;

(h) cold rolling said material to provide a 60–75% reduction to give a final thickness; and (i) annealing said material for 50–200 hours at 850–900° C. in a reducing atmosphere whereby a high magnetic saturating, primary recrystallized material is produced.

2. The process of claim 1, wherein said final thickness is 0.004–0.008 inches.

3. The process of claim 2, wherein said material is air quenched after said 5–50 minute anneal.

4. The process of claim 3, wherein said material is air quenched after said 20–60 minute recrystallization.

5. The process of claim 4, wherein said material is heated to 850–900° C. for 10–50 minutes in dry hydrogen immediately prior to said 5–50 minute anneal.

6. The process of claim 5, wherein said 20–60 minute recrystallization atmosphere is dry hydrogen.

7. The process of claim 6, wherein said 5–50 minute annealing atmosphere is dry hydrogen.

8. The process of claim 7, wherein said material is deoxidized to an oxygen content of less than 20 ppm and said carbon content is adjusted to 0.010–0.015%.

9. The process of claim 1, wherein said material is heated in an inert atmosphere retort prior to being hot rolled, and is hot rolled in air.

* * * * *